US006863189B1

(12) United States Patent
Teppe

(10) Patent No.: US 6,863,189 B1
(45) Date of Patent: Mar. 8, 2005

(54) QUICK OPENING CLOSURE FOR SMALL LIQUID CONTAINERS

(75) Inventor: Bruno Teppe, Viriat (FR)

(73) Assignee: L & M Services B.V., Amsterdam (NL)

( * ) Notice: Subject to any disclaimer, the term of this patent is extended or adjusted under 35 U.S.C. 154(b) by 0 days.

(21) Appl. No.: 09/936,182

(22) PCT Filed: Mar. 9, 1999

(86) PCT No.: PCT/FR00/00576

§ 371 (c)(1),
(2), (4) Date: Sep. 7, 2001

(87) PCT Pub. No.: WO00/55064

PCT Pub. Date: Sep. 21, 2000

(30) Foreign Application Priority Data

Mar. 12, 1999 (FR) ..... 99 03262

(51) Int. Cl.[7] ..... B65D 43/16

(52) U.S. Cl. ..... 215/322; 215/386; 220/252; 220/254.1; 220/254.3; 220/345.1; 220/345.6; 220/351; 220/811

(58) Field of Search ..... 215/322, 386, 215/295, 305, 306, 320; 220/252, 810, 820, 831–832, 345.1, 345.6, 351, 614, 811–813, 254.1, 254.3, 254.5; 222/559–561; 16/319, 321, 324, 303, 333, 271, 224

(56) References Cited

U.S. PATENT DOCUMENTS

| | | | | | |
|---|---|---|---|---|---|
| 988,116 | A | * | 3/1911 | Lee et al. | 215/322 |
| 1,977,302 | A | * | 10/1934 | Brill | 220/833 |
| 2,529,817 | A | * | 11/1950 | Russell | 222/556 |
| 3,955,241 | A | * | 5/1976 | Little | 16/298 |
| 4,925,043 | A | * | 5/1990 | Dinand | 215/322 |
| 5,273,172 | A | * | 12/1993 | Rossbach et al. | 215/229 |
| 5,405,034 | A | * | 4/1995 | Mittel, Jr. | 215/322 |
| 5,547,099 | A | * | 8/1996 | Chang | 220/254.3 |
| 6,354,454 | B1 | * | 3/2002 | Wong | 220/345.1 |

FOREIGN PATENT DOCUMENTS

DE 40 23 978 * 2/1992

* cited by examiner

*Primary Examiner*—Robin A. Hylton
(74) *Attorney, Agent, or Firm*—Fletcher Yoder

(57) ABSTRACT

The closing device consisting of a sleeve that seals onto the neck of a bottle and that comprises an internal channel which opens, via a new orifice in a sliding-contact surface with associated slopes and slideways acting as guide means to a shut-off plate for closing the new orifice which is moved translationally by a knob, which sliding-contact surface may be planar or in the form of a sector of a cylinder of revolution or in the form of a portion of a sphere.

3 Claims, 3 Drawing Sheets

QUICK OPENING CLOSURE FOR SMALL LIQUID CONTAINERS

The present invention relates to a quick closing and opening device designed to be fitted to small liquid containers such as glass or thermoplastic bottles.

There is wide use of glass or thermoplastic bottles comprising a neck closed by a cork stopper forced into the neck or a cap screwed or clipped or crimped onto the outer side wall of the neck in order to compress a seal against the top of the neck: to remove these stoppers or caps, the bottle must be held in one hand and the cork or cap removed with the other. This occupies both hands and means that the cork must be put down if one hand is to be freed to hold a glass: the movement of extracting the cork is a movement of rotation and traction followed possibly by a movement of laying it down, which takes time and which requires at least as much time for the reverse operation. In the case of beer and lemonade there exists a reusable system of closing glass bottles comprising a plug fitting into the neck. This is generally made of porcelain with a thick rubber annular seal combined with a clamping device which clamps the plug by using the elastic compressibility of the seal: as non-returnable bottles are used more and more, this closing device is tending to disappear; this closing system is easy to open and the plug stays attached to the neck, but on the other hand it is slightly more difficult to reclose.

In bars there are bottles in which the neck is equipped with a small-diameter spout, comprising an air inlet device, but these are not airtight; there are also measuring stoppers attached to bottles of apéritifs which are placed upside down on holders: these devices only deliver small amounts of liquid when the edge of the glass is pressed firmly against guards which move and raise a valve, so that the liquid is released.

Some faucets connected to a supply of fluid under pressure or to a large container have quick-closing devices using two spherical or cylindrical surfaces of the same curvature, one sliding inside the other in order to position two openings in alignment or out of alignment to allow a fluid to pass through: examples are faucets with a spherical or cylindrical plug that is opened or closed by a quarter-revolution of a control lever, such as faucets for wooden barrels, certain "ball-type" sink faucets, and the valves situated at the ends of fire nozzles; all these devices can be used with only one hand and allow rapid opening and closing. These faucets are generally made of metal and use precision components which are expensive.

The object of the invention is to propose a closing device that can be operated by a single simple movement to both close and open it, of the type defined in the preamble of claim 1 and known from the combination of patents CH-A-249764, DE-A-2409760 and U.S. Pat. No. 2,141,572, but that is leaktight and not very expensive so that it can be used on small containers of liquids, even if aerated, and in particular on bottles that have a neck.

Described below is a device fitted to a bottle that has a screwthreaded neck, but it should be understood that the device can be transposed to other types of necks and containers.

Figure 1:
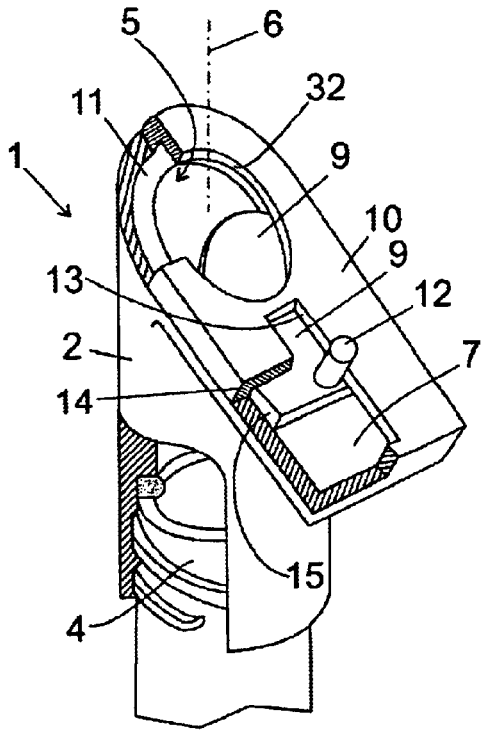
FIG. 1 is an exploded perspective view of a closing device according to the invention using a sliding-contact surface employing planar translation guided by slopes.
Figure 2:
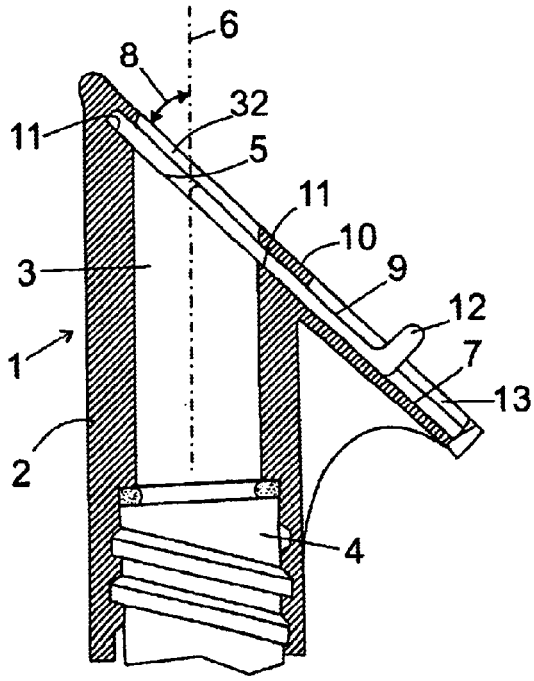
FIG. 2 is a section taken on a plane of symmetry of the closing device seen in FIG. 1.

A closing device 1 (FIGS. 1 and 2) according to the invention consists of a sleeve 2 comprising an internal channel 3 which opens at one end on a means of leaktight connection between the closing device and the neck 4 of a bottle and at the other end in a plane or convex curved sliding-contact surface forming the new orifice 5 of the bottle, to which sealing means are connected: the plane or convex curved sliding-contact surface acts as a bearing surface for means of shutting off the new orifice 5 and also comprises guide means and means for shutting off said orifice. These means of shutting off the new orifice are displaced by translation or rotation by a simple manual action on a control means in order to close or open the new orifice 5.

It will now be assumed that the bottle has an essentially cylindrical neck 4 (FIGS. 1 and 2) with a main axis of symmetry of revolution. The means of leaktight connection of the sleeve to the neck 4 of the bottle generally uses the same means of attaching the stopper or cap which may be an external thread or a snap-on bead or a cylindrical surface inside the neck for a stopper: leaktightness is provided by known means such as a flexible seal compressed between the sleeve 1 and the upper edge of the neck 4 or a skirt resting on the inner cylindrical edge of the neck.

The sleeve 2 comprises an internal channel in the form of a cylinder of revolution 3 whose axis of symmetry 6 coincides with the main axis of symmetry of revolution of the open neck 4, thus providing a new orifice 5, in a planar sliding-contact surface 7 integral with the sleeve 2, forming an angle 8 of about forty-five degrees with the axis of symmetry 6 of the sleeve 2; this sliding-contact surface 7, which has associated guide means, acts as a bearing surface to a rigid planar shut-off plate 9 with sufficient surface area to close off the whole or part of the new orifice 5 when displaced by sliding it over the sliding-contact surface 7. The shut-off plate 9 is kept pressed against the sliding-contact surface 7 by at least one slope 10 which presses the shut-off plate 9 against the sliding-contact surface 7 by pressing on the opposite face to the bearing face of the shut-off plate 9, with a force of application varying as a function of their relative positions. The slopes 10 stop at the new orifice 5 and are fixed relative to the sliding-contact surface 7, creating a second orifice 32 that may be used to support a spout (not shown in the drawings). When the shut-off plate 9 closes the new orifice 5, the slopes 10 press the shut-off plate 9 with force all the way around the perimeter 11 of said orifice 5 to ensure the best seal possible, whereas elsewhere the movement can be free. The shut-off plate 9 is displaced by translation, rotation or a combination of these two movements by control and guide means. A control means may be a knob 12 integral with the shut-off plate 9 and passing through a slot 13 formed either in the sliding-contact surface or in the slopes 10. A means of guiding the plate 9 in translation consists of two lateral slideways 14 situated in the planes parallel to each other and to the axis of symmetry 6, passing on either side of the new orifice 5 and on which two parallel edges 15 of the shut-off plate 9 press simultaneously.

A means of rotational guidance consists in pivoting a shut-off plate about an axis perpendicular to the planar sliding-contact surface with which it is integral; the movements of the shut-off plate are limited by end stops in the position of closure of the new orifice, as also in the open position.

Figure 3:
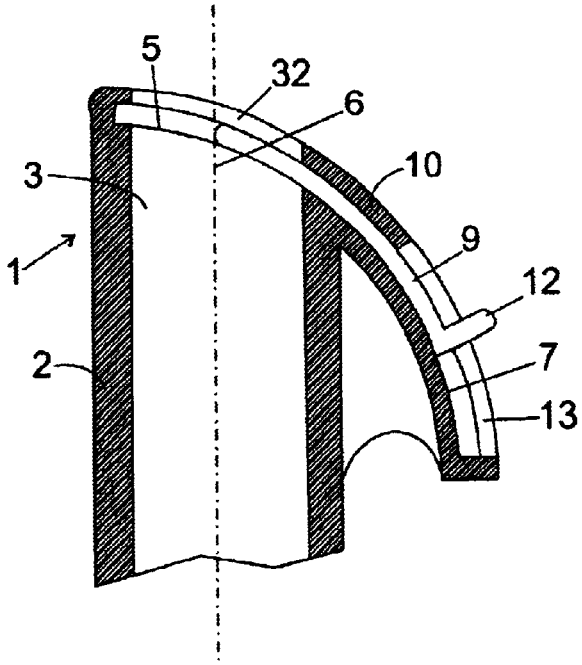
FIG. 3 is a section taken on a plane of symmetry of a variant of the closing device seen in FIG. 1 using a sliding-contact surface employing rotation of a cylinder of revolution or spherical rotation guided by slopes instead of a plane surface.
Figure 4:
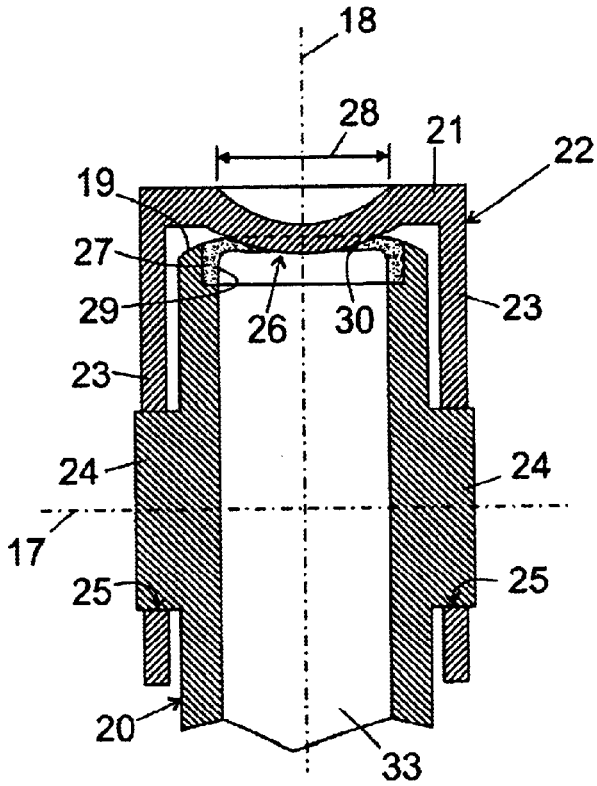
FIG. 4 is a section through a closing device using a sliding-contact surface employing cylindrical or spherical sliding guided in rotation by a caliper pivoting about an axis.

The above description of a shut-off plate having translational movement over a planar sliding-contact surface can be transposed to the case of a device (FIG. 3) whose sliding-contact surface is a sector of a cylinder of revolution, or a portion of a sphere. In the case of rotational sliding, it can only be transposed if the sliding-contact surface is a portion of a sphere.

Figure 5:
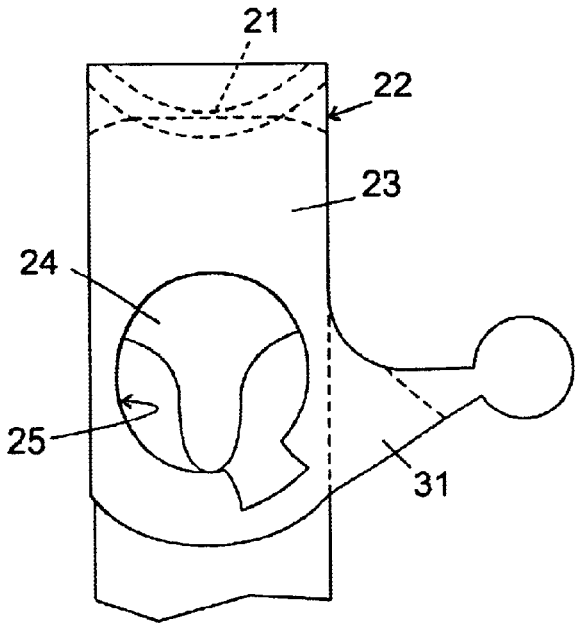
FIG. 5 is a side view of the closing device seen in FIG. 4 with the new orifice closed by the shut-off plate.
Figure 6:
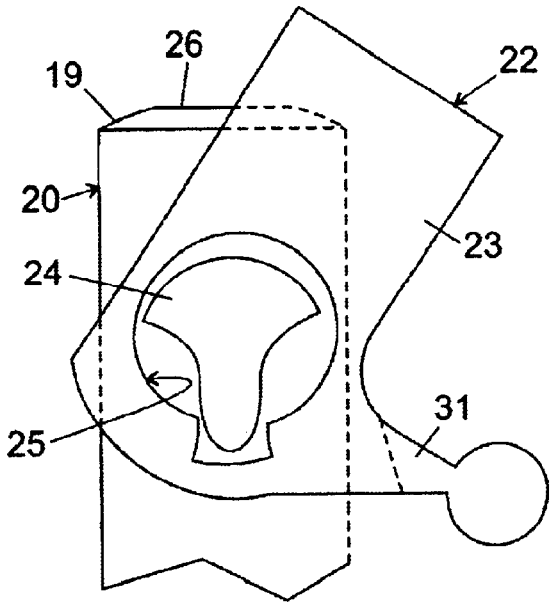
FIG. 6 is a side view of the closing device seen in FIG. 4 with the shut-off plate in the open position.

In another version of the invention, where the sliding-contact surface 19 is a sector of a cylinder or a portion of a sphere with an axis of symmetry of revolution 17 that essentially intersects the axis of symmetry 18 of the internal channel 33 of the sleeve 20 at right angles, the shut-off plate 21 can be provided with a caliper 22 pivoting about the axis of symmetry of revolution 17 via the ends of its two parallel arms 23. The sleeve may have two journals 24 at right angles to the side wall of the sleeve 20, on which the ends of the parallel arms 23 of the caliper 22 pivot, by means of a bore 25. The shapes of the journals 24 (FIGS. 5 and 6) and of the bores 25 are cams to make it possible to vary the pressure of the shut-off plate 21 on the sliding-contact surface 19 and in particular to increase the pressure when the new orifice 26 is closed. In an improvement of this version of the invention, particularly when a good gas seal is required, the new orifice 26 can be given a seal 27 with a flexible lip shaped essentially as a frustum of a cone of revolution whose large base 29 is integral with the edge of the new orifice 26 and whose small base 30 is slightly above the new orifice 26 when the orifice is open. The shut-off plate 21 comprises, in the area that covers the new orifice 26, a small spherical cap with a diameter 28 roughly the same as that of the new orifice 26 and with a radius of curvature of the spherical cap that is much greater. The bore 25 of the caliper 22 fitted to the journal 24 are shaped in such a way that, when closed, the spherical cap of the shut-off plate 21 is firmly pressed against the small base 30 of the lip seal 27, creating a sufficiently gastight seal, so that when the pressure of gas rises inside the bottle, and it is that pressure which, by deforming the lip seal 27, presses it more and more firmly against the spherical cap of the shut-off plate 21. A control lever 31 integral with the parallel arms 23 of the caliper 22 is used to place or remove the shut-off plate 21 by sliding it across the sliding-contact surface 19.

The closing device can be made for example from thermoplastic injection-molded parts cleaved or welded together.

What is claimed is:

1. A closing device adaptable to a glass or thermoplastic container comprising a neck closable by a stopper forced into the neck or screwed or clipped or crimped to the side wall of the neck while compressing a seal onto the upper end of the neck, the device comprising: a sleeve comprising an internal channel having an axis of symmetry that opens at one end having a leaktight connection of the closing device with respect to the neck of a container and at the other end having a sliding-contact surface which is a sector of a cylinder or a portion of a sphere, having an axis of symmetry of revolution that intersects the axis of symmetry of the internal channel of the sleeve at right angles, providing the bottle with a new orifice that can be closed by a shut-off plate connected to a caliper which pivots, via the ends of the caliper's two parallel arms, about two journals integral with the sleeve, on which the arms pivot by means of a bore, wherein the journals and the bores form cams that enable the pressure of the shut-off plate on the sliding-contact surface to be varied and the pressure of the sealing portion to be varied when the new orifice is closed using a control portion, and comprising a sealing portion having a seal with a flexible lip integral with the new orifice, shaped essentially as a frustum of a cone of revolution, while the shut-off plate comprises, in the area that covers the new orifice, a small spherical can with a diameter roughly the same as that of said orifice and with a radius of curvature of the spherical cap that is much greater.

2. The closing device as claimed in claim 1, wherein the control portion comprises a lever integral with the parallel arms of the caliper.

3. The closing device as claimed in claim 1, wherein the closing device is produced from thermoplastic injection-molded parts cleaved or welded together.

* * * * *